US011165195B1

(12) United States Patent
Liang

(10) Patent No.: US 11,165,195 B1
(45) Date of Patent: Nov. 2, 2021

(54) CONNECTOR ASSEMBLY APPLIED TO HIGH-VOLTAGE INTERFACE

(71) Applicant: CHARDON TAIWAN CORPORATION, Miao Li Hsien (TW)

(72) Inventor: Tsung-Mien Liang, Miao Li Hsien (TW)

(73) Assignee: CHARDON TAIWAN CORPORATION, Miao Li Hsien (TW)

( * ) Notice: Subject to any disclaimer, the term of this patent is extended or adjusted under 35 U.S.C. 154(b) by 0 days.

(21) Appl. No.: 16/894,747

(22) Filed: Jun. 5, 2020

(30) Foreign Application Priority Data

May 4, 2020 (TW) ..... 109114785

(51) Int. Cl.

| | |
|---|---|
| ***H01R 13/53*** | (2006.01) |
| ***H01R 4/58*** | (2006.01) |
| ***H01R 13/62*** | (2006.01) |
| ***H01R 13/506*** | (2006.01) |
| ***H01R 101/00*** | (2006.01) |

(52) U.S. Cl.
CPC ..... *H01R 13/53* (2013.01); *H01R 4/58* (2013.01); *H01R 13/506* (2013.01); *H01R 13/62* (2013.01); *H01R 2101/00* (2013.01)

(58) Field of Classification Search
CPC ..... H01R 13/52; H01R 13/5202; H01R 13/5205; H01R 13/5219; H01R 13/53; H01R 13/506; H01R 13/62; H01R 4/58; H01R 2101/00
See application file for complete search history.

(56) References Cited

U.S. PATENT DOCUMENTS 6,336,821 B1 * 1/2002 Hattori ..... H01R 13/17 439/282
9,831,596 B1 * 11/2017 Simas ..... H01R 13/622

* cited by examiner

*Primary Examiner* — Oscar C Jimenez
(74) *Attorney, Agent, or Firm* — Pai Patent & Trademark Law Firm; Chao-Chang David Pai

(57) ABSTRACT

A connector assembly applied to a high-voltage interface includes a first connector and a second connector to be connected to each other. The first connector has an accommodating groove. A socket is provided in the accommodating groove. The socket has an electrical connection hole, an elastic holding portion, and a first engaging portion. The second connector has a plug-in portion corresponding to the accommodating groove. The plug-in portion is provided with a conductive probe corresponding to the electrical connection hole and a second engaging portion corresponding to the first engaging portion. The accommodating groove, the electrical connection hole, the plug-in portion and the conductive probe are all parallel to the same axis, so that the first connector and the second connector are connected to each other in a sliding manner.

3 Claims, 6 Drawing Sheets

CONNECTOR ASSEMBLY APPLIED TO HIGH-VOLTAGE INTERFACE

FIELD OF THE INVENTION

The present invention relates to an electrical connector, and more particularly to a connector assembly applied to a high-voltage interface.

BACKGROUND OF THE INVENTION

There are many electrical devices in the existing high-voltage power distribution system, such as capacitors, transformers, switches, circuit breakers, fuses, and so on. These electrical devices are usually connected to each other through cables. The electrical devices and the cables are connected through a connector assembly. The connector assembly generally includes a connector with a male interface and another connector with a female interface disposed on the corresponding electrical device and the cable. The electrical device can be electrically connected to the cable as long as the connector having the male interface is connected to the connector having the female interface.

The aforementioned high-voltage distribution system requires regular maintenance, such as electricity inspection, grounding inspection, and high-voltage inspection. For safety reasons, it is required to disconnect the electrical device from the cable during maintenance. However, the connectors of the conventional connector assembly are connected to each other by screwing, which results in that users need to spend a lot of time and energy to connect or disconnect the connector having the male interface and the connector having the female interface. Accordingly, the inventor of the present invention has devoted himself based on his many years of practical experiences to solve these problems.

SUMMARY OF THE INVENTION

The primary object of the present invention is to provide a connector assembly applied to a high-voltage interface, which allows a user to connect and disconnect connectors in a slidable manner.

In order to achieve the aforesaid object, a connector assembly applied to a high-voltage interface is provided. The connector assembly comprises a first connector and a second connector to be connected to each other. The first connector is formed with at least one accommodating groove extending along an axis. A bottom of the accommodating groove is provided with a socket. The socket has at least one electrical connection hole therein corresponding to the accommodating groove. The electrical connection hole is parallel to the axis and communicates with the accommodating groove. An elastic holding portion is provided around the electrical connection hole. A first engaging portion is provided at the socket. A first conductor is connected to the socket. The second connector has a plug-in portion corresponding to the accommodating groove. The plug-in portion has a through hole therein. A second conductor is provided in the through hole. One end of the second conductor is provided with a conductive probe. The conductive probe has a contact portion corresponding to the electrical connection hole. The conductive probe has a second engaging portion corresponding to the first engaging portion.

In the connector assembly applied to a high-voltage interface provided by the present invention, because the accommodating groove and the electrical connection hole of the first connector, the plug-in portion of the second connector and the conductive probe are all parallel to the same axis, when the plug-in portion is inserted into the accommodating groove, the first engaging portion is engaged with the second engaging portion, so that the plug-in portion is secured in the accommodating groove stably, the contact portion of the conductive probe is inserted into the electrical connection hole, and the elastic holding portion elastically holds the contact portion to conduct the first conductor and the second conductor, thereby connecting or disconnecting the first connector and the second connector in a sliding manner.

DETAILED DESCRIPTION OF THE PREFERRED EMBODIMENTS

Embodiments of the present invention will now be described, by way of example only, with reference to the accompanying drawings.

Figure 1:
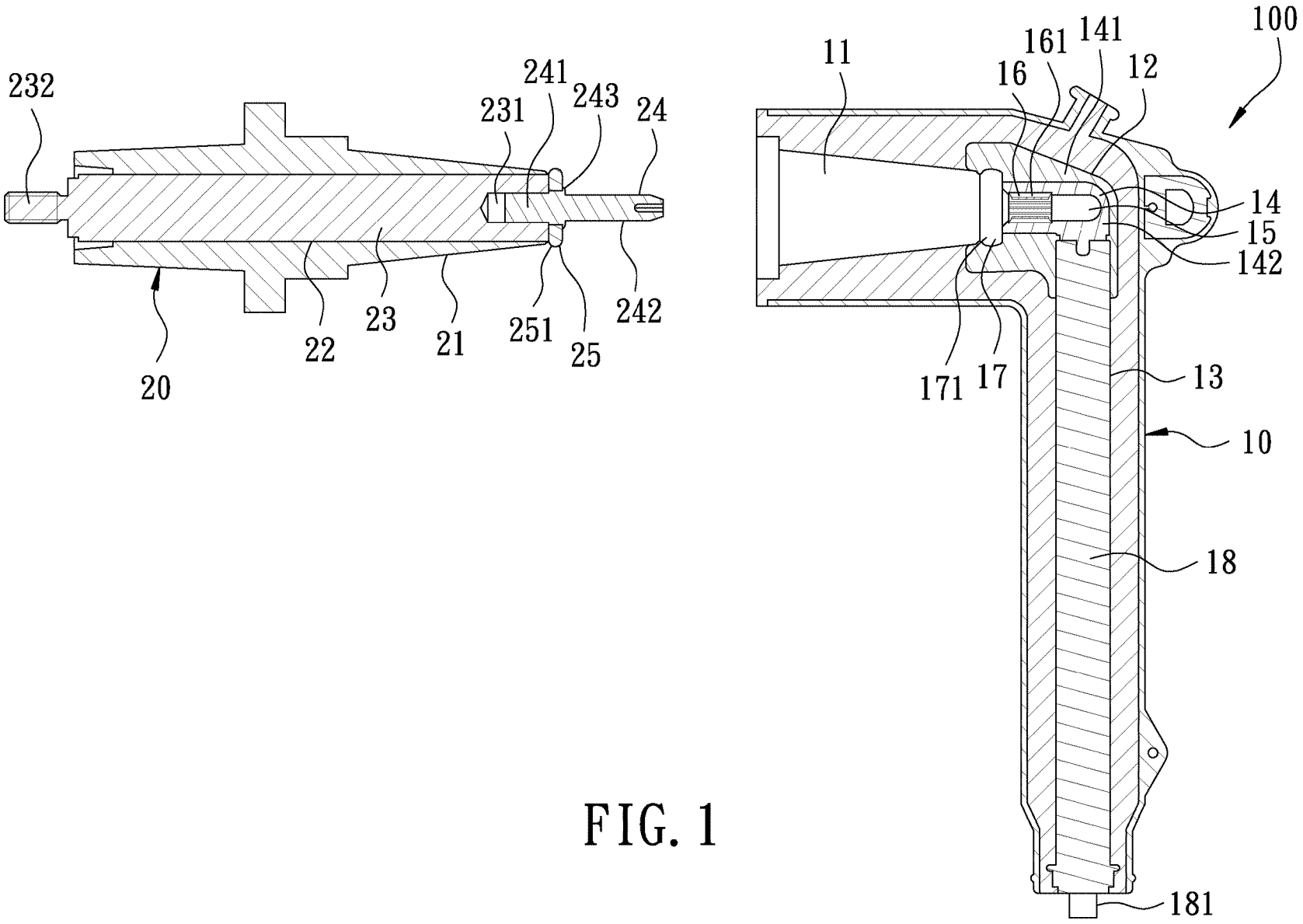
FIG. 1 is an exploded sectional view in accordance with a first embodiment of the present invention.
Figure 2:
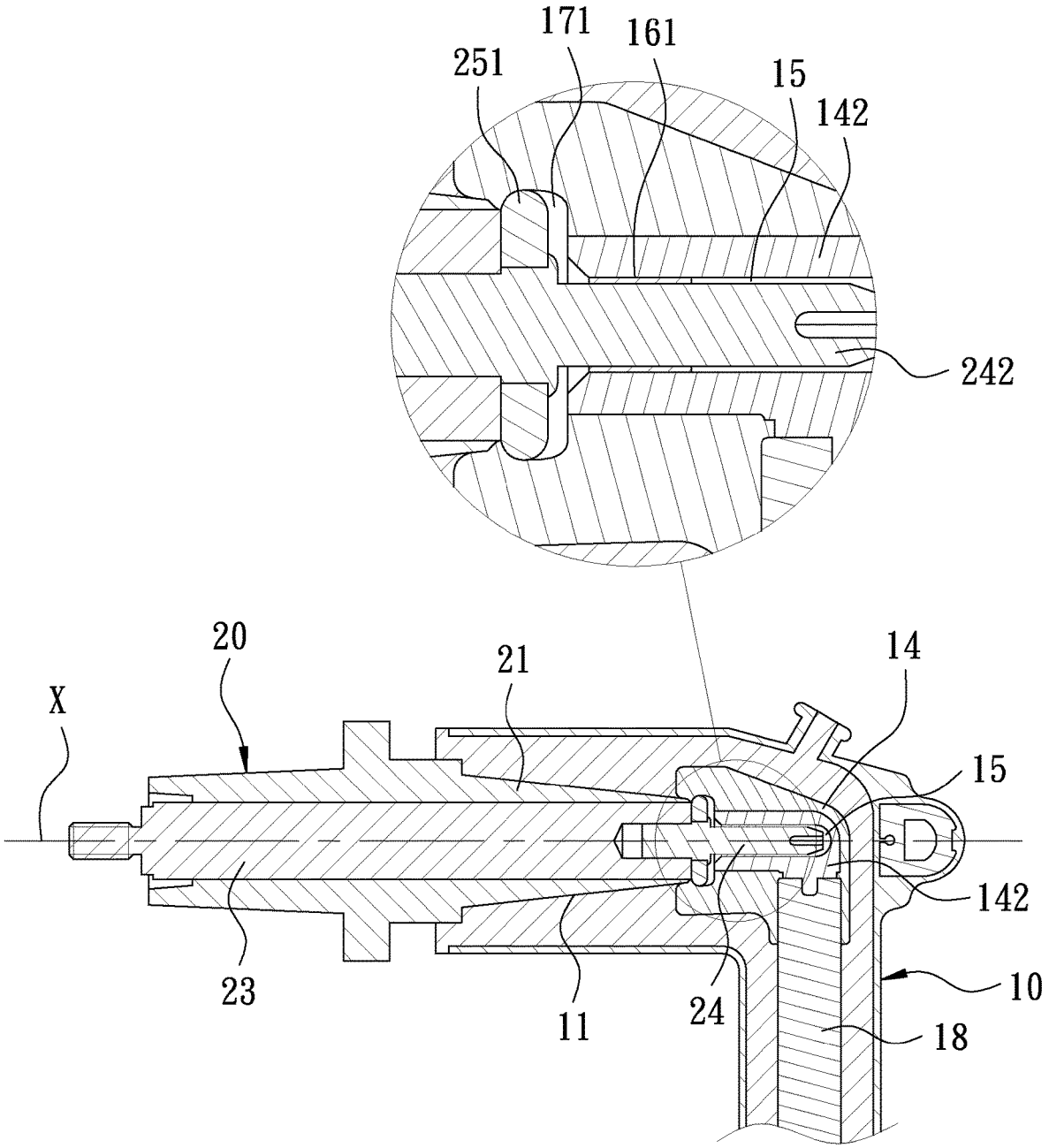
FIG. 2 is an assembled sectional view in accordance with the first embodiment of the present invention.

FIG. 1 is an exploded sectional view in accordance with a first embodiment of the present invention. FIG. 2 is an assembled sectional view in accordance with the first embodiment of the present invention. The present invention discloses a connector assembly 100 applied to a high-voltage interface. In this embodiment, the connector assembly 100 is a combination of a bushing and an elbow arrester, but it may be a combination of other high-voltage interfaces. This embodiment does not limit the scope of the present invention. The connector assembly 100 applied to a high-voltage interface comprises a first connector 10 and a second connector 20.

The first connector 10 is made of a resilient insulating material, such as rubber. One end of the first connector 10 is recessed along an axis X to form at least one accommodating groove 11. The bottom of the accommodating groove 11 is provided with a chamber 12. The other end of the first connector 10 is formed with a first through hole 13 communicating with the chamber 12. A socket 14 is provided in the chamber 12. The socket 14 has a fixing member 141. The fixing member 141 is made of a resilient insulating material and fixed in the chamber 12. A connecting member 142 is fixed to a middle portion of the fixing member 141. The connecting member 142 is made of a conductive material and has at least one electrical connection hole 15 therein corresponding to the accommodating groove 11. The electrical connection hole 15 is parallel to the axis X and communicates with the accommodating groove 11. In addition, an elastic holding portion 16 is provided around the electrical connection hole 15. The elastic holding portion 16 is composed of a plurality of elastic pieces 161 provided on the inner wall of the electrical connection hole 15. A first engaging portion 17 is provided at the socket 14. In this embodiment, the first engaging portion 17 is an engaging groove 171 around the outer side of the electrical connection hole 15. In addition, a first conductor 18 is provided in the first through hole 13. One end of the first conductor 18 is connected to the connecting member 142 of the socket 14, and the other end of the first conductor 18 forms a connecting end 181 for connecting an electrical device.

The second connector 20 is made of a resilient insulating material, such as rubber. The second connector 20 has a plug-in portion 21 corresponding to the accommodating groove 11. The plug-in portion 21 has a second through hole 22 therein. A second conductor 23 is provided in the second through hole 22. One end of the second conductor 23 is formed with a screw hole 231 for screwing a conductive probe 24, and the other end of the second conductor 23 is formed with a connecting portion 232 for connecting an electrical device. The conductive probe 24 has a threaded portion 241 corresponding to the screw hole 231. The threaded portion 241 is screwed into the screw hole 231. The conductive probe 24 has a contact portion 242 extending out of the plug-in portion 21 and corresponding to the electrical connection hole 15. The contact portion 242 is parallel to the axis X. The conductive probe 24 further has a second engaging portion 25 corresponding to the first engaging portion 17. In this embodiment, the second engaging portion 25 is an engaging ring 251 fitted onto the contact portion 242. The contact portion 242 of the conductive probe 24 has an annular flange 243 corresponding to the plug-in portion 21. The threaded portion 241 of the conductive probe 24 is first inserted through the engaging ring 251 and then screwed into the screw hole 231 to hold the engaging ring 251 between the plug-in portion 21 and the annular flange 243.

Referring to FIG. 1 and FIG. 2, because the accommodating groove 11 and the electrical connection hole 15 of the first connector 10, the plug-in portion 21 of the second connector 20 and the contact portion 242 of the conductive probe 24 are all parallel to the axis X, when the first connector 10 and the second connector 20 are to be connected, the plug-in portion 21 is aligned with and inserted into the accommodating groove 11 along the axis X, and the engaging ring 251 is engaged into the engaging groove 171, so that the plug-in portion 21 is secured in the accommodating groove 11 stably, and the contact portion 242 of the conductive probe 24 is inserted into the electrical connection hole 15 of the first connector 10, and the elastic pieces 161 of the elastic holding portion 16 elastically abut against the contact portion 242 to conduct the first conductor 18 and the second conductor 23. Furthermore, the electrical devices connected to the first connector 10 and the second connector 20 can be conducted to each other. When the first connector 10 and the second connector 20 are to be disengaged from each other, the user applies a force outwardly along the X axis to disengage the engaging ring 251 from the engaging groove 171, so that the first connector 10 and the second connector 20 can be separated easily. Thereby, the user can connect or disconnect the first connector 10 and the second connector 20 in a sliding manner.

Figure 3:
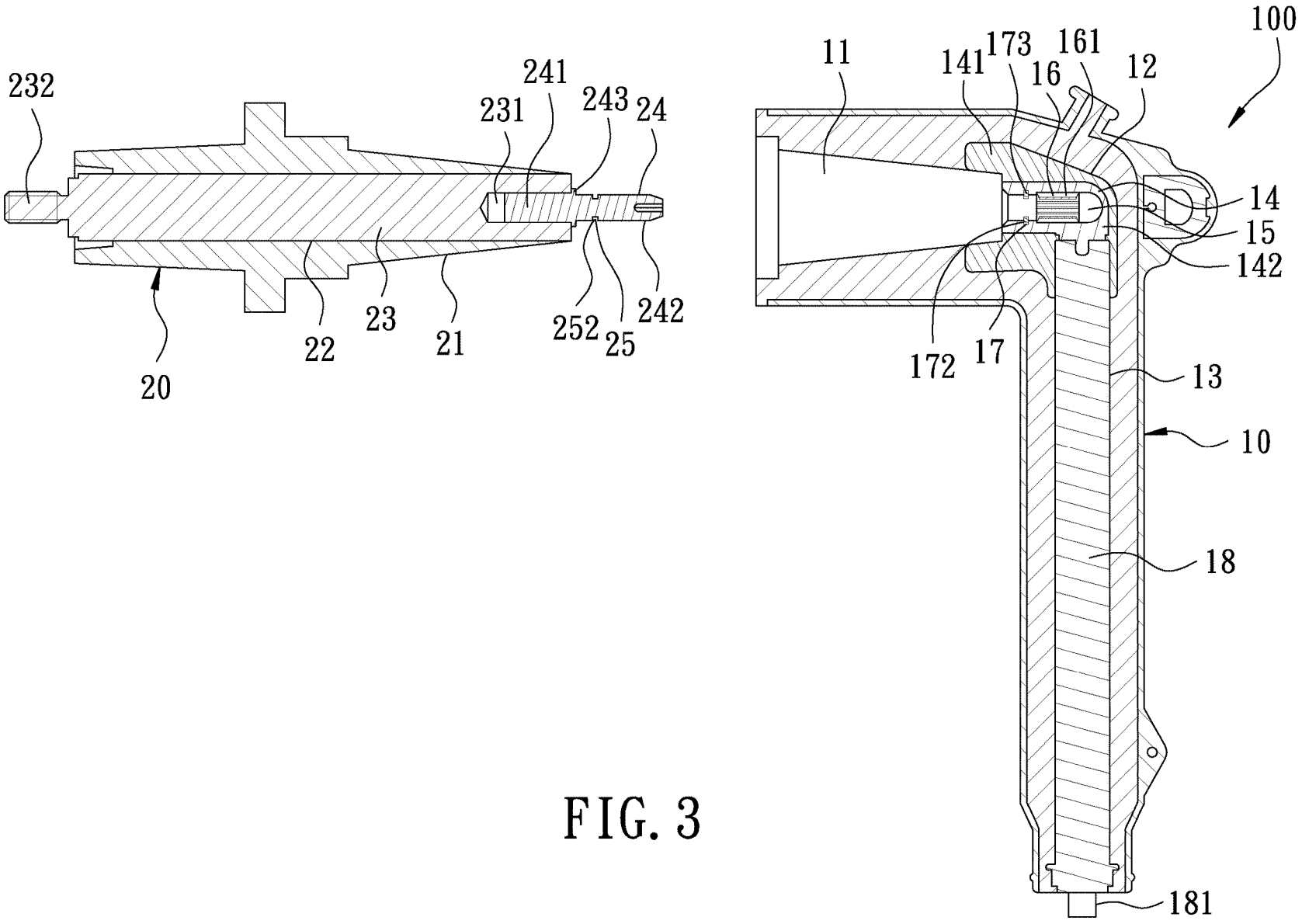
FIG. 3 is an exploded sectional view in accordance with a second embodiment of the present invention.
Figure 4:
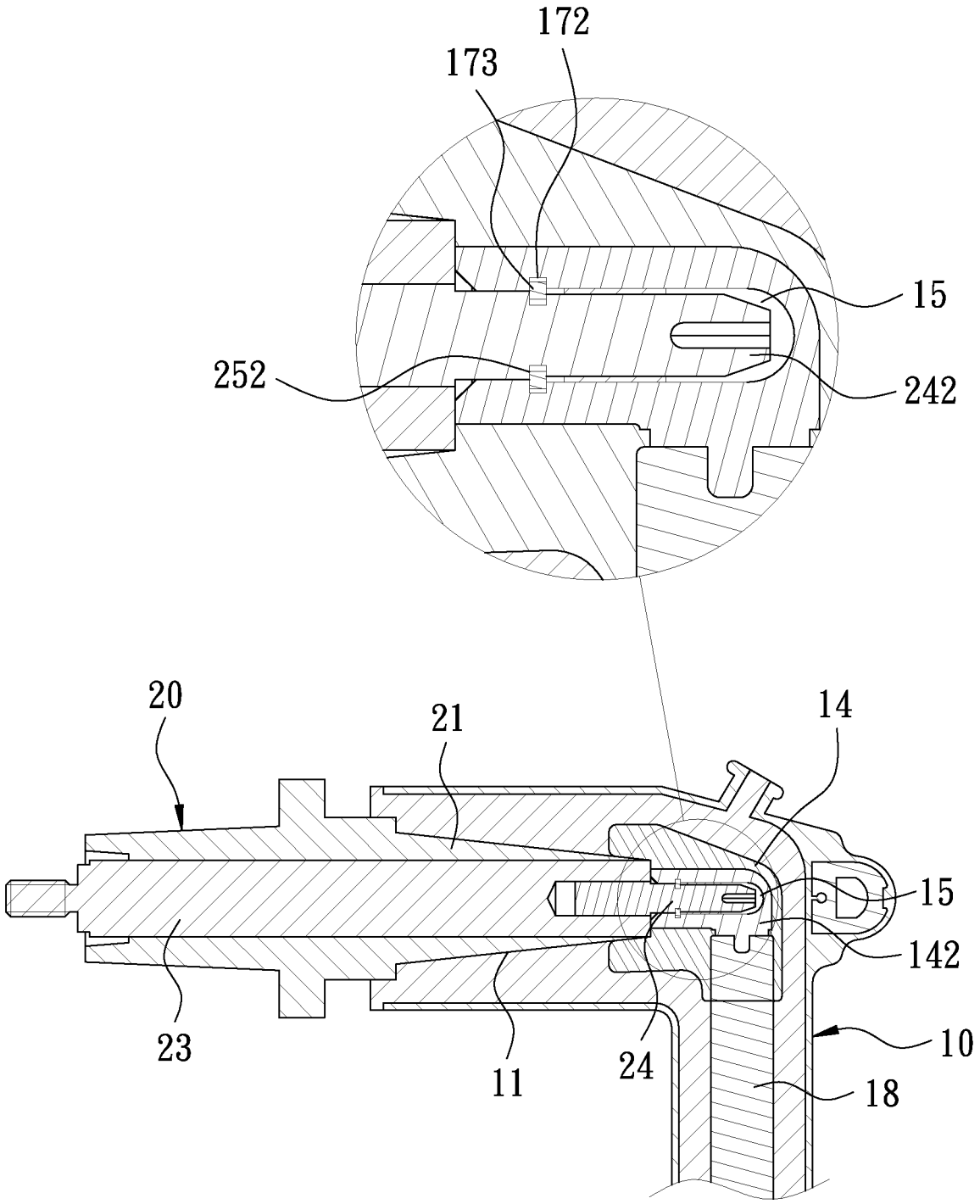
FIG. 4 is an assembled sectional view in accordance with the second embodiment of the present invention.

FIG. 3 is an exploded sectional view in accordance with a second embodiment of the present invention. FIG. 4 is an assembled sectional view in accordance with the second embodiment of the present invention. The connector assembly 100 applied to a high-voltage interface differs from the first embodiment in that the first engaging portion 17 has a groove 172 disposed around the inner wall of the electrical connection hole 15, an elastic retaining ring 173 is provided in the groove 172, and the second engaging portion 25 is an annular groove 252 disposed on the outer surface of the contact portion 242. Thus, when the plug-in portion 21 is aligned with and inserted into in accommodating groove 11 along the axis X and the contact portion 242 of the conductive probe 24 is inserted into the electrical connection hole 15, the elastic retaining ring 173 will be elastically snapped into the annular groove 252 to secure the plug-in portion 21 into the accommodating groove 11 stably.

Figure 5:
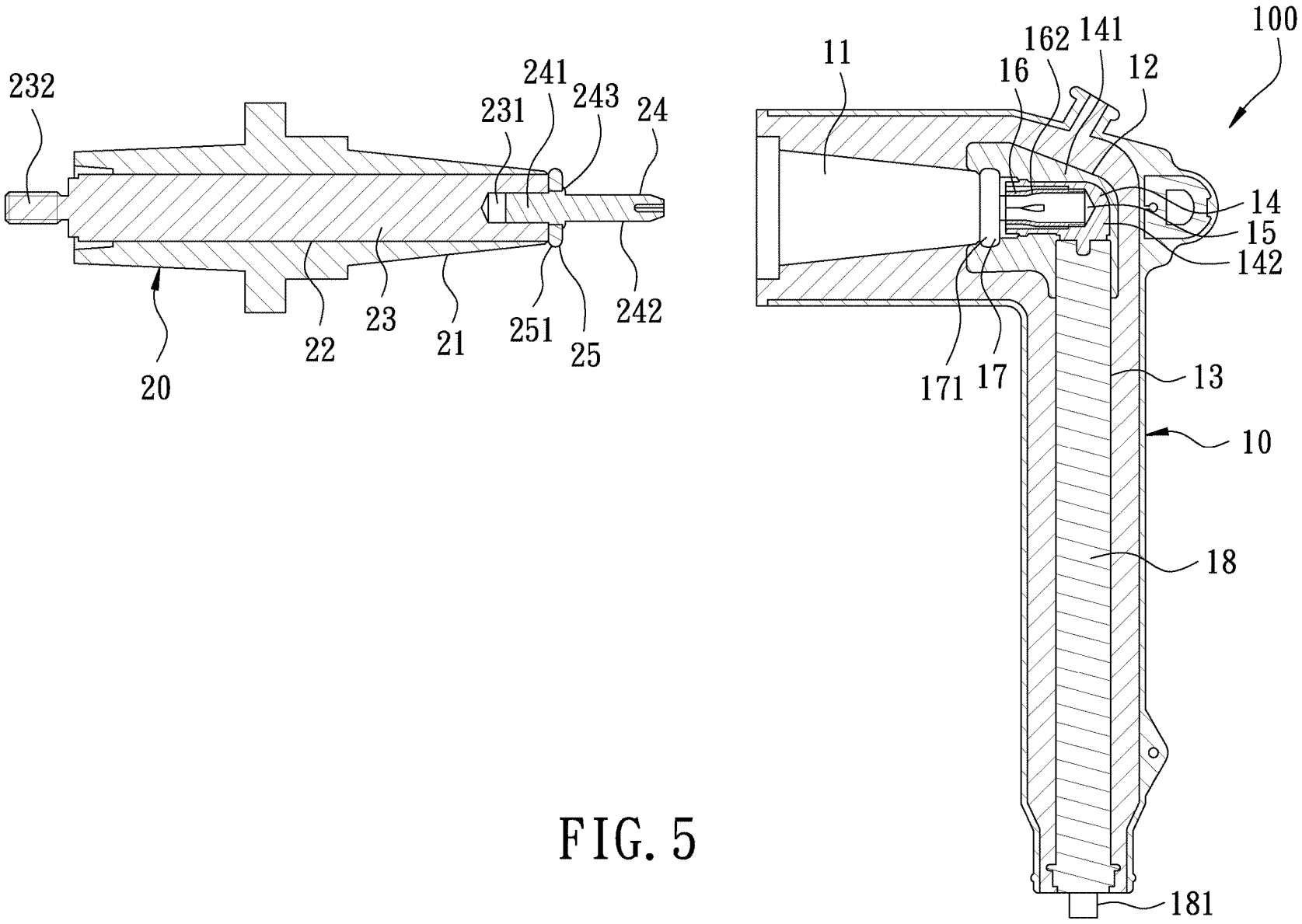
FIG. 5 is an exploded sectional view in accordance with a third embodiment of the present invention.
Figure 6:
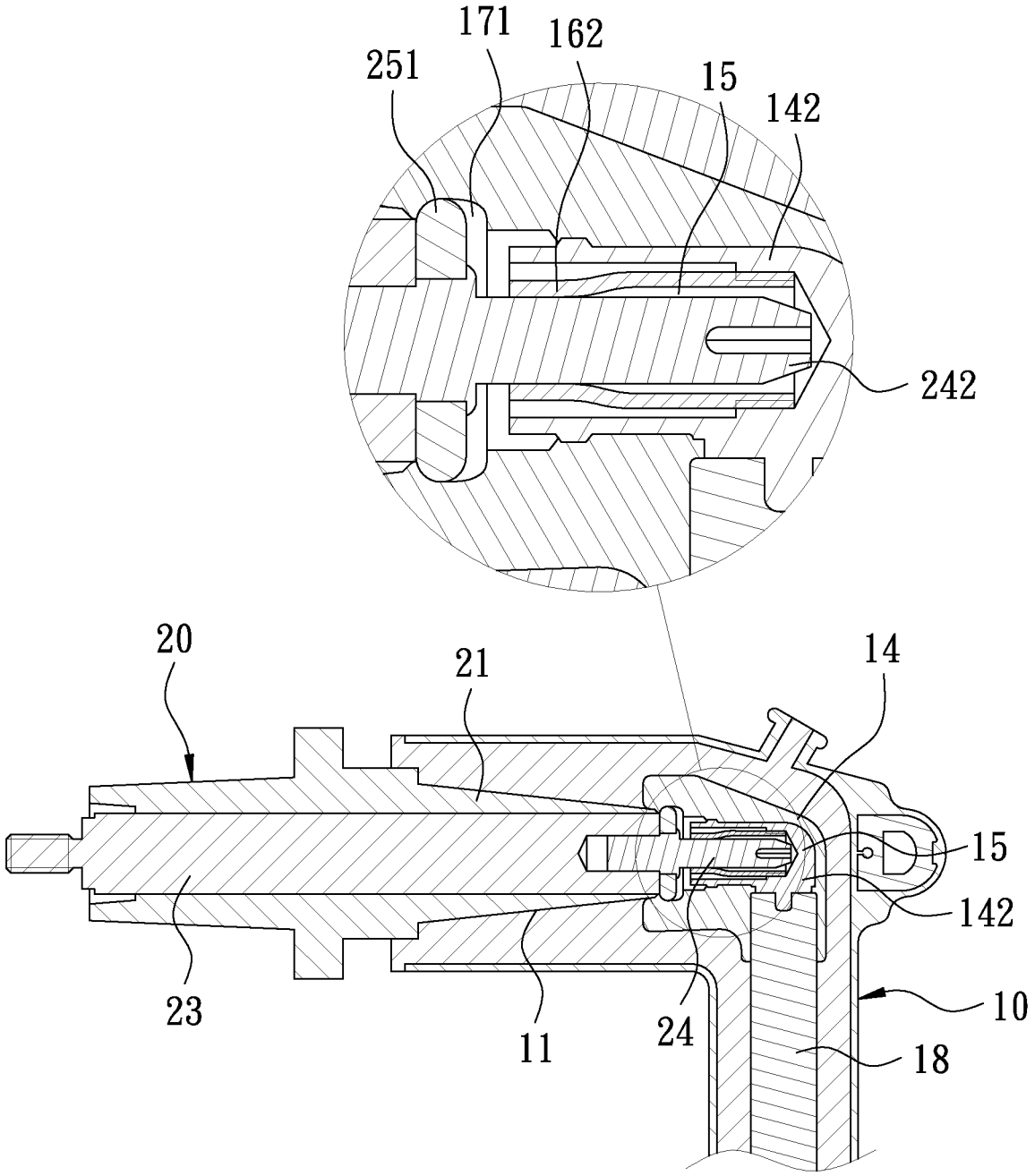
FIG. 6 is an assembled sectional view in accordance with the third embodiment of the present invention.

FIG. 5 is an exploded sectional view in accordance with a third embodiment of the present invention. FIG. 6 is an assembled sectional view in accordance with the third embodiment of the present invention. The connector assembly 100 applied to a high-voltage interface differs from the first embodiment in that the elastic holding portion 16 is composed of a plurality of elastic claws 162 extending outward from the electrical connection hole 15. Thus, when the plug-in portion 21 is aligned with and inserted into in accommodating groove 11 along the axis X and the contact portion 242 of the conductive probe 24 is inserted into the electrical connection hole 15, the elastic claws 162 will elastically hold the contact portion 242 of the conductive probe 24 to conduct the first conductor 18 and the second conductor 23.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A connector assembly applied to a high-voltage interface, comprising a first connector and a second connector to be connected to each other;

the first connector being formed with at least one accommodating groove extending along an axis, a bottom of the accommodating groove being provided with a socket, the socket having at least one electrical connection hole therein corresponding to the accommodating groove, the electrical connection hole being parallel to the axis and communicating with the accommodating groove, an elastic holding portion being provided around the electrical connection hole, the socket further having a first engaging portion, a first conductor being connected to the socket, wherein the first connector has a chamber therein, the socket has a fixing member secured in the chamber, a connecting member is fixed to the fixing member, the connecting member has the electrical connection hole therein, and the first engaging portion is an engaging groove around an outer side of the electrical connection hole;

the second connector having a plug-in portion corresponding to the accommodating groove, the plug-in portion having a through hole therein, a second conductor being provided in the through hole, one end of the second conductor being provided with a conductive probe, the conductive probe having a contact portion corresponding to the electrical connection hole, the conductive probe having a second engaging portion corresponding to the first engaging portion, wherein the second engaging portion is an engaging ring fitted onto the contact portion, the contact portion has an annular flange corresponding to the plug-in portion, and the engaging ring is held between the plug-in portion and the annular flange;

wherein when the plug-in portion is inserted into the accommodating groove, the first engaging portion is engaged with the second engaging portion, so that the plug-in portion is secured in the accommodating groove stably, the contact portion of the conductive probe is inserted into the electrical connection hole, and the elastic holding portion elastically holds the contact portion to conduct the first conductor and the second conductor, thereby connecting or disconnecting the first connector and the second connector in a sliding manner.

2. The connector assembly as claimed in claim 1, wherein the elastic holding portion is composed of a plurality of elastic pieces disposed on an inner wall of the electrical connection hole.

3. The connector assembly as claimed in claim 1, wherein the elastic holding portion is composed of a plurality of elastic claws extending outward from the electrical connection hole.

* * * * *